United States Patent [19]

Breuer

[11] Patent Number: 4,569,269

[45] Date of Patent: Feb. 11, 1986

[54] MANUAL ACTUATOR FOR RECOIL-OPERATED BREECH

[75] Inventor: Heinz G. Breuer, Duisburg, Fed. Rep. of Germany

[73] Assignee: Rheinmetall G.m.b.H., Duesseldorf, Fed. Rep. of Germany

[21] Appl. No.: 481,639

[22] Filed: Apr. 4, 1983

[30] Foreign Application Priority Data

Apr. 3, 1982 [DE] Fed. Rep. of Germany ..... 3212522

[51] Int. Cl.[4] ..... F41F 11/02

[52] U.S. Cl. ..... 89/24

[58] Field of Search ..... 89/22, 24, 1 K, 4 B, 89/167, 173, 186

[56] References Cited

U.S. PATENT DOCUMENTS

| | | | |
|---|---|---|---|
| 1,232,090 | 7/1917 | Rimailho | 89/4 B |
| 2,216,860 | 10/1940 | Summer | 89/24 X |
| 2,756,635 | 7/1956 | Engel et al. | 89/24 X |
| 3,362,292 | 1/1968 | D'Andrea | 89/24 |

*Primary Examiner*—Stephen C. Bentley

*Assistant Examiner*—John S. Maples

[57] ABSTRACT

A large-caliber gun has a breech support, a breech block movable relative thereto between open and closed positions, and a shaft centered on an axis and rotatable therabout in the support. Link mechanism connects the shaft and the breech block for angularly displacing the shaft between first and second positions respectively corresponding to the open and closed breech positions. A crank is fixed on the shaft. A lever pivotal about the axis between first and second positions has an abutment engageable angularly in only one direction with the crank. The shaft and crank are angularly displaceable independently of the lever. The lever can be pivoted from its second to its first position to similarly pivot the crank and shaft and displace the breech block into the open position. A spring-loaded biasing unit is connected between the lever and the crank and urges the crank angularly back against the abutment of the lever. Thus when the crank and shaft are moved by gun recoil from their second to their first position the biasing means is stressed, while the lever remains in its first position.

12 Claims, 5 Drawing Figures

MANUAL ACTUATOR FOR RECOIL-OPERATED BREECH

FIELD OF THE INVENTION

The present invention relates to a recoil-operated breechblock. More particularly this invention concerns a large-caliber artillery piece or howitzer whose breech is opened after each shot by mechanism powered by the recoil energy of the shot.

BACKGROUND OF THE INVENTION

It is standard in a large artillery piece, as for example the gun described in U.S. Pat. No. 2,756,635, for the firing-tube or barrel recoil to serve to slide open the breechblock and even extract the spent shell case, with the breechblock being latched in the open position. The breechblock is slid open against the force of a spring which is simultaneously loaded by the recoil force. The gunner chambers a new round and unlatches the breechblock which slides closed under the force of the loaded spring so the shot can be fired and a new cycle started. Such an arrangement can even be combined with an automatic recharging device.

At the start of firing it is necessary to manually open the breechblock and chamber a round, and it is occasionally necessary, as when a dud must be extracted, to have to manually close the breech. This operation is effected by a so-called charging handle connected via a crank of cam mechanism to the breechblock. The gunner must pivot this charging lever to slide the breechblock up, thereby opening the chamber and loading the recoil spring. Obviously the amount of force necessary to do this is considerable, since the lever simultaneously lifts the weight of the breechblock, overcomes the friction of the relatively massive mechanism, and loads the normally very stiff spring.

In order to ease this manual operation it is therefore standard to provide a relatively long charging handle. This maximizing of the lever arm does make operation simpler, but requires that quite some room be left free behind the piece. To overcome this problem it has been suggested to use a short lever connected to the breech-operating mechanism by stepdown gearing and a ratchet arrangement. Such a system is compact, but requires considerable ratcheting action, and the extra gearing increases losses in the manual actuator while adding to the complexity and bulk of the device.

It is also known, as for example from U.S. Pat. No. 3,362,292 to use a complex cam and latch arrangement in conjunction with a torsion-type leaf spring. Such a system can operate with a very short recoil stroke, but is so very complex that it adds greatly to the cost of the piece. The system has a plurality of cams and catches that rub on each other, creating considerable mechanical-energy losses that must be made up for by using a powerful recoil spring.

OBJECTS OF THE INVENTION

It is therefore an object of the present invention to provide an improved manual actuator for a recoil-type breech operating mechanism.

Another object is the provision of such a manual actuator for a recoil-type breech operating mechanism which overcomes the above-given disadvantages.

A yet further object is to provide a large-caliber gun having a manual breech-opening and closing mechanism which operates easily and which is extremely simple is design.

SUMMARY OF THE INVENTION

These objects are attained according to the instant invention in a large-caliber gun having, as is known, a breech support, a breechblock movable relative thereto between open and closed positions, and a shaft centered on an axis and rotatable thereabout in the support. Link means, normally constituted as a crank or cam, connects the shaft and the breechblock for slidably displacing the breechblock between first and second positions respectively corresponding to the open and closed breech positions. A crank is fixed on the shaft. A lever pivotal about the axis between first and second positions has an abutment engageable angularly in only one direction with the crank. The shaft and crank are angularly displaceable independently of the lever when said lever is latched in the second position. The lever can be pivoted from its second to its first position to similarly pivot the crank and shaft and displace the breechblock into the open position. Biasing means connected between the lever and the crank urges the crank angularly back against the abutment of the lever. Thus when the crank and shaft are moved by gun recoil from their back to their front position the biasing means is stressed.

With the system according to the present invention, therefore, when the lever is moved from its second position into its first position, for manual opening of the breechblock, it directly pivots the crank and shaft. It does not, however, load or increase stress in the biasing means. Since this biasing means urges the crank angularly back against the abutment of the lever, during forward angular displacement of the lever from its second to its first position these two elements will therefore lie against each other, with no relative movement. The biasing means will therefore be unaffected on the forward stroke so the gunner is merely working through the lever to the extent necessary to move the breechblock into its open position. Once in this open position the breech block latches, so when the lever is pivoted back it pulls the abutment away from the crank and stresses or loads the biasing means. The work done in manually opening the breechblock is therefore divided up between the forward and return stroke of the lever, the forward stroke serving to displace the breechblock and the return stroke to load the biasing means. This is altogether different from the prior-art systems wherein the forward stroke of the lever serves both to displace the breechblock and to load the biasing means whereas the return stroke does no useful work.

According to this invention the lever is tubular, contains the biasing means, and has an end engaging around and pivoted with the crank. In addition the lever is of oval section and of thin wall thickness. The biasing means itself includes a spring braced to resist separation of the lever and crank. This can be done in a piston-and-cylinder unit having an outer closed cylinder end pivoted on the lever and a piston having a rod extending through the opposite inner cylinder end and pivoted on the crank. Compression springs engage between the inner face of the piston, that is its face turned toward the shaft axis, and the inner end of the cylinder to resist expansion of the unit. Such a thoroughly closed unit can be expected to have a long service life, and can even serve a damping effect by minimal reconstruction.

The lever normally stays in a second position during automatic opening of the breechblock after each shot.

In fact according to this invention a releasable latch is provided for securing the lever on the support in the second position.

In case the breechblock jams closed or hangs up on automatic opening, a stop on the lever can be engaged in front of the crank in a direction opposite that of the abutment. Thus this stop can be engaged with the crank for manual opening of the breechblock. This feature is therefore very simple, and during such manual opening there also is no loading of the spring so it is easy. The biasing force of the biasing means is such that it takes about the same amount of force to manually open the breechblock as it does to stress the biasing means on displacement of the lever from the first to the second position when the crank remains in the first position.

In addition according to this invention the biasing means includes a spring and is so constructed that the force needed to displace the lever from its first to its second position when the crank stays in its first position is generally constant, at least during the first half of the return stroke.

DESCRIPTION OF THE DRAWING

The above and other features and advantages will become more readily apparent from the following, reference being made to the accompanying drawing in which.

SPECIFIC DESCRIPTION

Figure 1:
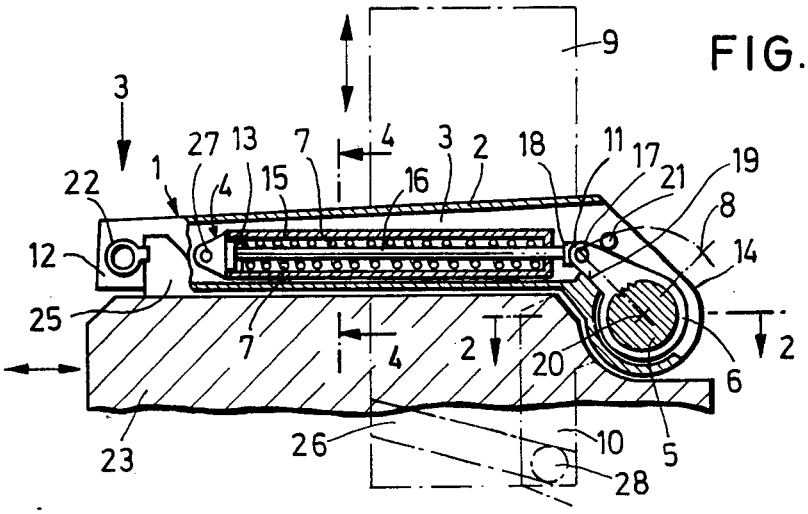
FIG. 1 is a vertical section through the breech actuator according to this invention.
Figure 2:
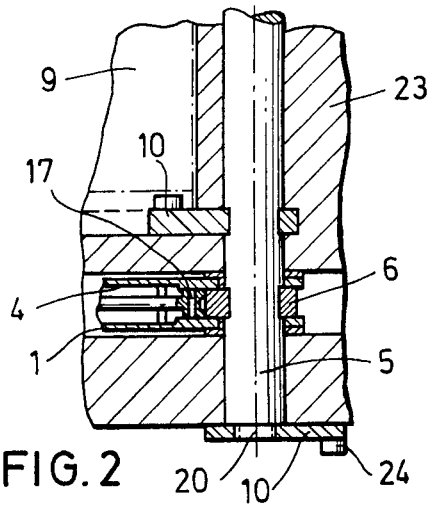
FIG. 2 is a section taken along line 2—2 of FIG. 1.
Figure 4:
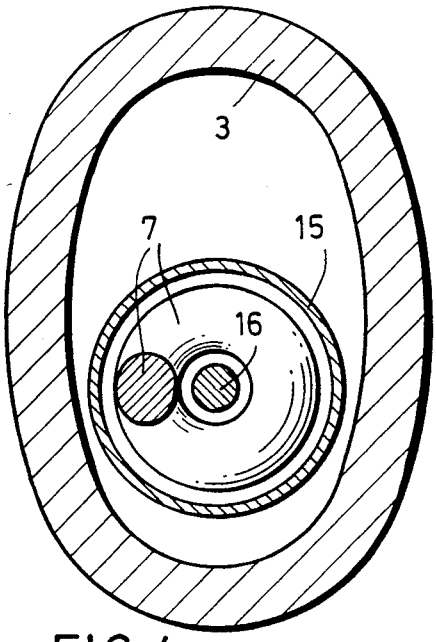
FIG. 4 is a section taken along line 4—4 of FIG. 1.

As seen in FIGS. 1 and 2 a breech support 23 that normally moves horizontally during recoil with each shot carries a vertically slidable breechblock 9. A main operating shaft 5 is journaled about a horizontal axis 20 in the support 23 and is provided at one end with a crank 24 by means of which it is pivoted through about 90° each time the gun is fired, normally by a cam on the gun carriage. This shaft 5 also carries a lever 10 having a crank pin 28 engaging in a groove 26 of the breechblock 9. Thus as the shaft 5 pivots between the second position indicated at 11 and the first position indicated at 8 the breechblock 9 is made to slide between the closed and open positions, respectively, the breechblock 9 being in the illustrated embodiment higher in its open position than in its illustrated closed position, although the opposite arrangement is common. This action is, as is known per se, powered by the recoil force of the piece after each shot.

A charging handle or lever 1 according to this invention has one end 14 pivoted on the shaft 5 about the axis 20 and has an oval-section tubular body 2 whose hollow interior 3 is provided with a biasing unit 4. The shaft 5 carries and is fixed rotationally to a main operating crank 6 connected to this biasing unit 4, which serves to store up mechanical energy during recoil after a shot so this energy can be used later, as is known per se, to close the breechblock 9 when a new round has been chambered.

To this end the biasing unit 4 comprises a cylinder 15 having an outer end pivoted at 27 adjacent the outer end 12 of the lever 1. A piston 13 inside this sleeve or cylinder 15 has a rod 16 with an end 18 pivoted at 17 on the outer end of the crank 6. One or more coil springs 7 surround this rod 16 and are braced between the cylinder 15 and piston 13 so that they seek to pull the two pivots 17 and 27 toward each other, thereby pulling the crank 6 backward into the starting position 11. In this position 11 the crank 6 lies on and bears backward against an abutment or stop 19 of the lever 1.

Figure 3:
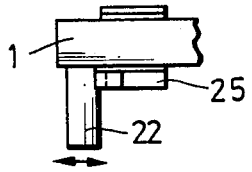
FIG. 3 is a top view of the detail indicated at 3 in FIG. 1.

The outer end 12 of the lever 1 is provided with a latch 22 that is movable parallel to the lever 1 as indicated by the double-headed arrow in FIG. 3, and that normally is spring-biased into engagement with a keeper 25 that latches the lever 1 in the second position illustrated in FIG. 1.

Thus during normal recoil after firing the crank 6 pivots from the second position 11 to the first position 8, which action compresses and loads the springs 7. When the breechblock 9 arrives at the fully open position, corresponding to the first position 8 of the crank 6, it is latched in place, thereby retaining the springs 7 loaded. The spent shell case is normally extracted automatically as the breechblock 9 opens, so once it is latched open the gunner can reload. The breechblock 9 is then unlatched so that the force stored in the springs 7 serves to pivot the shaft 5 into the second position 11, thereby closing the breech so the piece is ready to fire again.

At the start of shooting, however, the breechblock 9 must be manually opened and the first shell chambered in the gun, invariably starting from the breech-closed position corresponding to second position 11 of the crank 6 and shaft 5. To manually open the breechblock 9 the gunner pulls the latch 22 away from the keeper 25 to free the lever 1 and pivot it clockwise in the drawing, through 90°. Since the abutment 19 engages forward against the crank 6, this pivoting will therefore pivotally entrain the crank 6 and shaft 5 to cause bolt 28 in grooves 26 to slide up the breechblock 9. The amount of force that is needed to do this is only that which is enough to overcome the weight of the breechblock 9 and the friction between it and the few parts connected to it. During such pivoting from position 11 to position 8 there is no relative movement of the pivots 17 and 27 so that the spring 7 remains relatively uncompressed.

Once the breechblock 9 has been opened, the lever 1 is pulled back down. Such return movement will pull the pivots 17 and 27 apart, thereby expanding the biasing unit 4 and loading the spring 7 since the breechblock 9 latches in the open position to fix the shaft 5 against rotation about its axis 20. The unit 4 is therefore loaded on the return stroke of the lever 1, and this is virtually all the work that is being done by the lever 1 during such return stroke. As a result the force that need be exerted manually on the lever 1 is spread out between its forward and return stroke, thereby making the system very easy to operate, and allowing a relatively short lever with a relatively short stroke to be used.

If the breechblock 9 hangs up between the open and closed position it is possible to use the lever 1 to manually close it. To this end a latch bolt 21 displaceable parallel to the axis 20 can be moved into position behind the crank 6, opposite that side that engages the abutment 19. Thus when the breechblock must be forcibly closed, the lever 1 is swung up as if for a normal opening movement and when in the fully raised position the bolt 21 is advanced to hold the crank 6 down against the abutment 19. The lever 1 is then coupled in the backward direction to the crank 6 and can be forcibly pulled back, entraining the shaft 5 and breechblock 9.

Figure 5:
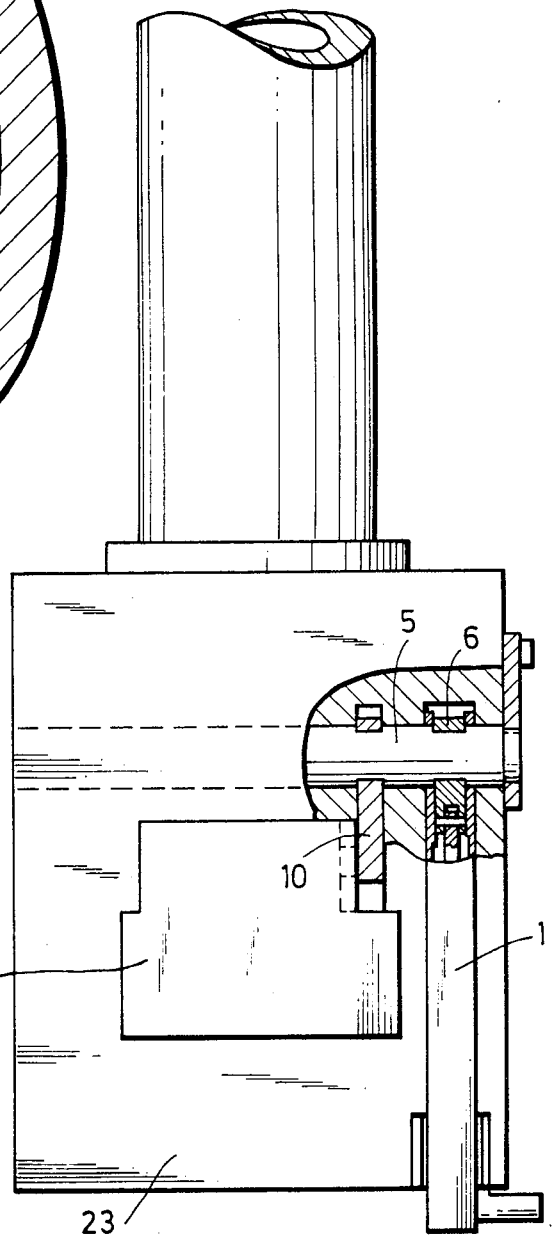
FIG. 5 is a plan view, partially in cross-section, illustrating the rear end of a gun barrel and breech mechanism incorporating the invention.

FIG. 5 illustrates the rear end of a large caliber gun barrel having the lever 1, the breech block 9, the breech support 23 for the breech block 9 as well as the crank 6.

The system according to this invention is therefore simple in the extreme. During manual opening of the breechblock the gunner need only exert enough force to overcome friction and move the breechblock, the loading of the recoil spring takes place only when the lever is pulled back. As a result this manual operation is greatly eased. In addition its biasing unit is safely housed in the lever which can be a thin-wall casting that wholly contains it and protects it.

I claim:

1. A large-caliber gun comprising:

a breech support;

a breechblock movable relative to said support between open and closed breech positions;

a shaft centered on an axis rotatable about its axis in the support;

link means connecting the shaft and the breechblock for angularly displacing the shaft between first and second positions respectively corresponding to the open and closed breech positions;

a crank fixed on the shaft;

a lever pivotal about the axis between first and second positions and having an abutment which makes contact with one side of the crank when the breechblock is closed, the shaft and crank being angularly displaceable independently of the lever and wherein the lever can be manually pivoted from its second to its first position to similarly pivot the crank and shaft and displace the breechblock into the open position; and biasing means connected between the lever and the crank for urging the crank angularly back against the abutment of the lever, whereby when the crank and shaft are moved by gun recoil from their second to their first positions the biasing means is stressed, while the lever remains in its said first position.

2. The gun defined in claim 1, further comprising latch means for releasably securing the lever on the breech support in the second position.

3. The gun defined in claim 1 wherein the biasing means includes a spring and is so constructed that the force needed to displace the lever from its first to its second position when the crank stays in its first position is generally constant at least during the first half of the return stroke.

4. The gun defined in claim 1, further comprising a bolt on the lever releasably engageable with the other side of the crank, whereby the bolt can be engaged with the crank for manual closing of the breech.

5. The gun defined in claim 4 wherein the biasing force of the biasing means is such that it takes about the same amount of force to manually open the breechblock as it does to stress the biasing means on displacement of the lever from the first to the second position when the crank remains in the first position.

6. The gun defined in claim 1 wherein the lever is tubular, contains the biasing means, and has an end engaging around the crank.

7. The gun defined in claim 6 wherein the lever is of oval section and flares toward the shaft.

8. The gun defined in claim 6 wherein the lever is pivoted on the shaft.

9. The gun defined in claim 1 wherein the lever is tubular and contains the biasing means.

10. The gun defined in claim 9 wherein the biasing means includes a spring arranged between the lever and crank.

11. The gun defined in claim 3 wherein the biasing means includes a piston-and-cylinder unit having opposite axial ends, the piston of which is prestressed by said biasing means.

12. A large-caliber gun comprising:

a breech support;

a breechblock movable relative thereto between open and closed positions;

a shaft centered on an axis and rotatable thereabout in the support;

link means connecting the shaft and the breech block for angularly displacing the shaft between first and second positions respectively corresponding to the open and closed breech positions;

a crank fixed on the shaft;

a tubular lever pivotal about the axis between first and second positions and having an abutment engageable angularly in only one direction with the crank, the shaft and crank being angularly displaceable independently of the lever from their second to their first positions and consequently displace the breechblock into the open position; and biasing means including a spring housed in the lever and connected between the lever and the crank for urging the crank angularly back against the abutment of the lever, whereby when the crank and shaft are moved by gun recoil from their second to their first positions the biasing means is stressed, while the lever remains in its said first position.

* * * * *